United States Patent [19]

Hon

[11] Patent Number: 4,898,513

[45] Date of Patent: Feb. 6, 1990

[54] CIRCULATING WATER SYSTEM AND SUMP PUMP STRAINER APPARATUS

[75] Inventor: Clarence C. Hon, Cherry Hill, N.J.

[73] Assignee: Mobil Oil Corp., New York, N.Y.

[21] Appl. No.: 361,463

[22] Filed: Jun. 5, 1989

[51] Int. Cl.[4] ..... F04D 29/70

[52] U.S. Cl. ..... 415/121.2; 210/238; 210/416.1; 417/423.9

[58] Field of Search ..... 415/121.2, 24; 210/238, 210/416.1; 417/423.9

[56] References Cited

U.S. PATENT DOCUMENTS

| | | | |
|---|---|---|---|
| 1,456,979 | 5/1923 | Good | 210/416.1 |
| 1,909,578 | 5/1933 | Franke | 415/7 |
| 3,033,125 | 5/1962 | Pleuger | 415/121.2 |
| 4,461,614 | 7/1984 | Niedermeyer | 415/121.2 |

FOREIGN PATENT DOCUMENTS

| | | | |
|---|---|---|---|
| 107933 | 4/1925 | Switzerland | 415/182.1 |
| 1038615 | 8/1983 | U.S.S.R. | 415/121.2 |

*Primary Examiner*—Robert E. Garrett
*Assistant Examiner*—John T. Kwon
*Attorney, Agent, or Firm*—Alexander J. McKillop; Charles J. Speciale; Robert B. Furr, Jr.

[57] ABSTRACT

Heat transfer is improved and maintenance down time is decreased by a method for collecting particulates on a hinged perforate strainer at the inlet of a sump pump in a circulating water system. An improved sump pump strainer apparatus is also disclosed.

12 Claims, 2 Drawing Sheets

CIRCULATING WATER SYSTEM AND SUMP PUMP STRAINER APPARATUS

BACKGROUND OF THE INVENTION

The present invention includes a method for improving heat transfer and reducing maintenance-related down time in a circulating water system. The invention also encompasses an improved sump pump apparatus useful in conjunction with the method of the invention. More particularly, the method of the invention reduces plugging in cooling water heat exchangers in a closed-loop circulating cooling water system.

In closed loop liquid circulation circuits, such as cooling tower systems, particulates tend to accumulate in the water reservoir or sump. In systems closed to the atmosphere, the particulates include corrosion products, precipitated mineral salts and precipitates formed by chemical additives. Systems open to the atmosphere, on the other hand, accumulate not only corrosion products and precipitated minerals but also airborne dirt, stones and vegetation.

For a general discussion of circulating water systems and particularly the associated corrosion treatment programs, see the Nalco Water Handbook, McGraw-Hill, 1979. The following background information is drawn from 24 Kirk Othmer Encyclopaedia of Chemical Technology, 3rd Ed. 385.

Improvements in the field of circulating water systems, particularly cooling water systems would indeed contribute to reducing maintenance and energy costs in industrial facilities. Cooling is the largest industrial use for water. Generally, cooling water quality should be maintained to neither permit the formation of deposits, which reduce heat transfer or increase resistance to the flow of water, nor permit significant deterioration of the materials of construction in the cooling system.

Accumulation of deposits in process pumps and heat exchange equipment can reduce heat transfer, reduce water flow, cause premature equipment deterioration or failure and reduce product quality or yield. Unscheduled shutdowns to repair pump failures or plugged heat exchangers cost valuable production time.

Deposits may consist of sedimentary materials, e.g. sand, silt, or clay; corrosion products, e.g. rust, formed in place or transported from another part of the system; crystalline scales formed in situ; bacterial or fungal slimes; or other materials. Usually, water system deposit consist of mixtures of several types of materials. Reduced water flow results from the same types of deposits but usually in larger accumulations and at locations other than heat-transfer surfaces. Premature equipment deterioration or failure may be caused by contact with the waters used in industrial systems. Corrosion of metallic equipment and components is the most common manifestation, but non-metallic materials, e.g. wood, concrete and plastics, also deteriorate as a result of contact with industrial waters. Equipment deterioration may also be caused by erosion or abrasion by solids suspended in the water; equipment may fail catastrophically as a result of water-caused problems. Reduction of product quality can be caused by impurities present in the water entering a system or by those which develop as a result of corrosion, bacterial growth, or other problems within the system.

Both the composition of make-up water as well as the recirculation rate affect the development of waterside problems including the accumulation of particulates. In once-through systems drawing water from rivers,lakes, or the sea and returning it directly thereto after passage through heat-exchange equipment, the water problems depend upon the composition of the influent water since there is little, if any, change in water composition during its passage through the process equipment.

Nonevaporative, closed circulating systems include hot-water heating, high temperature water, chilled water, combined chilled and hot water, solar heating, snow melting, and brine systems. These systems frequently involve a cyclic change in temperature during operation and minor changes in composition develop primarily as a result of a reaction of the water with system components. In theory, such systems require no make-up water because they are closed and, therefore, water-caused problems should be minimal. However, the constant influx of make-up water together with essentially no flushing, or blowdown, leads to accumulation of particulates generated by oxidation, scale formation, and bacterial or fungal growth.

Evaporative, open circulating systems include spray-type humidifiers and cooling water-systems, e.g. cooling towers, evaporative condensers, or evaporative coolers. The evaporation increases the dissolved solids, leading to scale formation. In addition, gases and solids are scrubbed from the air through which the water is sprayed. Oxygen and sometimes sulfur oxides from stack gases are dissolved, increasing the corrosivity of the water. Particulates scrubbed from the air abrade moving parts, form heat-insulating deposits, promote localized corrosion, or result in undesirable growths of microorganisms.

In both open and closed circulating water systems, temperature increases promote scale formation and corrosion. Dissolved-solids concentrations increase in evaporative systems and promote scale formation. Condensation and dilution promote corrosion which produces particulate corrosion products. Any contact with air further accelerates corrosion by oxygenating the water, but spraying of the water through air as in an evaporative cooling tower adds not only oxygen but also finely divided solids and microorganisms to the water. While circulating water systems behave differently depending on the relative severities of these various factors, all of the factors contribute to some extent to cause operational problems resulting from the circulation and deposition of particulate solids within the system.

Suspended or colloidal solids can be reduced or removed by rough screening, sedimentation, centriugal separation, strainging, filtration, coagulation, flocculation, magnetic separation, or combinations of these processes. Clarification frequently describes a combination of these processes. The selection of the appropriate method or methods for each case depends upon the maximum concentration acceptable for the final use of the water. Particle size is an important consideration for the use of screening, straining, filtration, and coagulation.

Rough screening is used for the removal of large objects, e.g. logs, fish, masses of water weeds or algae, and other floating debris. Depending upon the screen opening, it may be used for the removal of particles as small as about 5 mm. Equipment for rough screening ranges from trash rack with bars spaced several inches apart, commonly called grizzlies, to screens with openings as small as 5 mm.

Straining and filtration are used for the removal of all types of particulate matter as small as about 0.01 mm. Woven mesh is available in a broad range of openings and a variety of weaves and materials. Granular media for filtration include sand and gravel, anthracite coal, and garnet. Mixed granular-media filters provide greater in-depth loading and, therefore, longer runs between backwashing than do single-media filters. They can be used for waters containing up to about 500 mg/L or less of suspended matter, whereas woven-media filters or strainers are practical for waters with about one tenth this concentration. Woven-media filters precoated with filter aids, e.g. diatomaceous earth, are used to polish waters containing about 10 mg/L or less of suspended solids, and remove particles as small as 0.001 mm. Membrane filters are used for ultrafiltration to remove even smaller particles.

The pump which withdraws water from the reservoir or sump is typically equipped with a single stage coarse strainer to prevent the largest of these particles from entering and damaging the pump and downstream equipment.

Smaller particles are segregated from the circulating water stream by in-line filters. One of the more popular in-line filters comprises an elongated woven conical screen fixed to an annular ring drilled with bolt holes. The conical screen is held in place by positioning the annular ring between the faces of a bolted flanged pipe fitting. While this design is relatively simple and inexpensive, it unfortunately requires flanged connections to be broken to clean out the filter screens. This maintenance typically requires a system shut-down.

U.S. Pat. No. 1,909,578 to Franke teaches a floating pump which includes a mesh filter to prevent entry of grit into the pump. U.S. Pat. No. 4,461,614 to Niedermeyer discloses a sump pump having a debris trap to prevent small debris such as sand and stones from being drawn into the pump by the inpeller. The strainer may optionally be hinged so that unfiltered liquid may flow directly into the impeller assembly.

Previous developments in the field of circulating water systems have, however, failed to provide for a convenient method for decreasing particulate accumulation in the associated downstream process equipment and to provide for orderly shutdown of the circulating water circuit when maintenance cleaning is required.

SUMMARY OF THE INVENTION

The present invention prolongs on-stream time between maintenance shutdowns, improves heat transfer, decreases pressure drop and provides for the orderly shutdown of the circulating water circuit when maintenance cleaning is necessary.

The invention accomplishes these and other objects in an appratus comprising a centrifugal pump for withdrawing liquid from a reservoir comprising a pump housing having motor mounting means at an upper end, a pump intake conduit affixed to a lower end of the pump housing, the intake conduit having a fluid intake opening, a first perforate strainer covering the fluid intake opening, a first perforate strainer covering the fluid intake opening, a second perforate strainer encasing the first perforate strainer, the second perforate strainer having finer perforations than the first perforate strainer and having open area at least equal to that of the first perforate strainer, a perforate door in the second perforate strainer hingeably attached to the second perforate strainer, the perforate door including means for retaining the perforate door closed during normal pump operation, and lifting means attached to the perforate door for remotely opening the perforate door.

The invention further comprises a method for improving the heat transfer efficiently and decreasing maintenance down time by reducing particulate accumulation in a circulating cooling water system employing a centrifugal sump pump comprising the steps of positioning a first perforate strainer and a second perforate strainer to cover the fluid intake opening of the centrifugal sump pump, the second perforate strainer encasing the first perforate strainer and including a perforate door having means in association with the perforate door for retaining the perforate door closed during normal pump operation, the second perforate strainer having finer perforations than the first perforate strainer and having open area at least equal to that of the first perforate strainer, removing particulates from cooling water entering the fluid intake opening of the centrifugal sump pump by retaining the particulates on said second perforate strainer, monitoring the operation of the centrifugal sump to detect insufficient fluid flow through the centrifugal sump pump, and opening the perforate door to increase fluid flow through the centrifugal sump pump for a time sufficient to prepare the circulating cooling water system for orderly shutdown.

DETAILED DESCRIPTION

Figure 1:
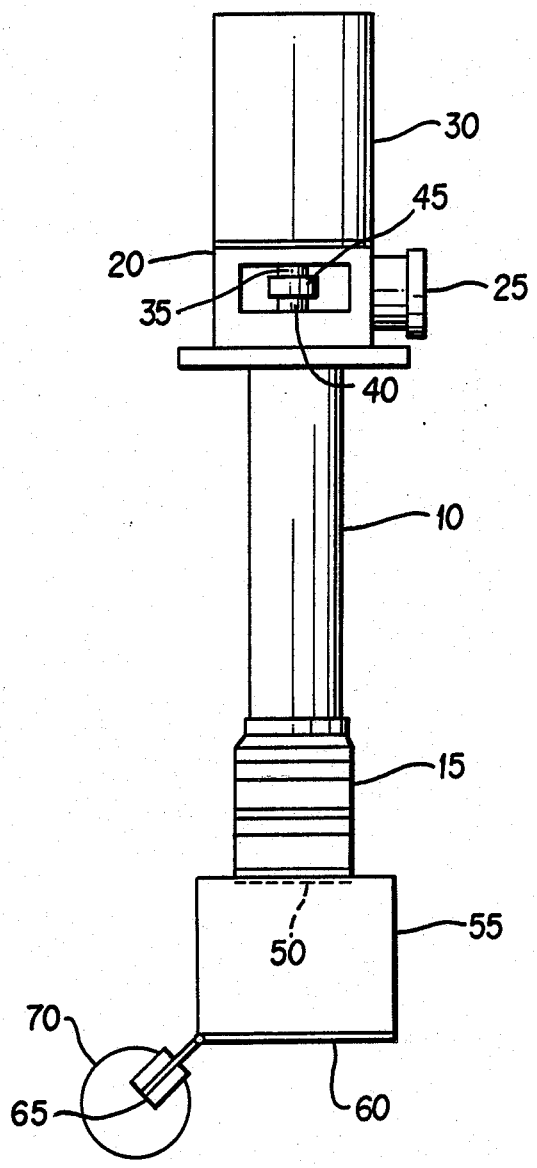
FIG. 1 is a simplified diagram showing major operating parts of the centrifugal sump pump of the present invention with the perforate door illustrated in the closed position for normal operation.
Figure 2:
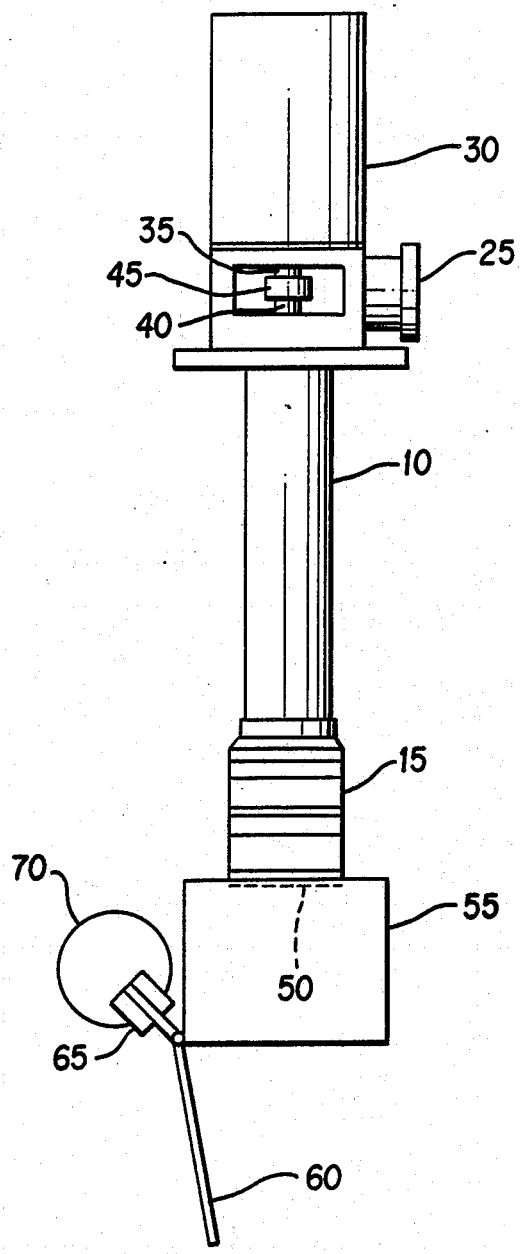
FIG. 2 is a simplified diagram showing major operating parts of the sump pump of the present invention with the perforate door in the open position.

Referring to FIG. 1, the centrifugal sump pump of the invention is schematically shown. The centrifugal sump pump housing 10 includes impeller housing 15 as well as motor mount 20 and discharge nozzle 25.

An electric motor, steam turbine or other suitable drive means 30 is affixed to motor mount 20 and the rotating drive shaft 35 of drive means 30 connects with pump shaft 40 through coupling 45.

Pump shaft 40 extends downwardly through the sump pump housing to connect with one or more centrifugal impellers located in impeller housing 15.

Impeller housing 15 forms a fluid intake opening which is covered by a first perforate strainer 50. Perforate strainer 50 is a coarse strainer useful for retaining relatively large objects, typically objects having a minor dimension of more than 0.5–1.0 inch. A second perforate strainer 55 having smaller perforations than the first perforate strainer forms a cage surrounding the first perforate strainer 50. The second perforate strainer includes a perforate hinged door 60 which is held normally closed by counterbalance weight 65 and which may be swung to an open positin by engaging and urging upward lift ring 70.

Operation of the sump pump in accordance with the invention is accomplished by submerging the pump apparatus in a sufficient depth of liquid in a reservoir to provide the requisite inlet pressure, or head. In circulating water systems, this reservoir typically acts as a settling vessel for particulates including corrosion products, chemical precipitates, sand, organic matter and vegatation. These materials can collect in downstream equipment causing decreased heat transfer and increased pressure drop if drawn into the sump pump inlet. The method and apparatus of the present invention prevent this highly undesirable result while advantageously maintaining adequate flow through the sump pump.

During normal operation of a circulating water system, particulates which form in the process equipment as well as those introduced into the circulating water system from outside collect in the reservoir. Rather than to introduce these particulates into the process piping and then retain the particulates in an in-line filter, the present invention retains the particulates in the circulating water system reservoir where they are essentially harmless.

The particulates retained in the reservoir will either settle to the bottom of the reservoir or will be suspended in the water depending on their shape, size and density. The second perforate strainer 55 collects a substantial portion of these suspended particles on its outer surface and retains the particles within the reservoir. The perforations of the second perforate strainer 55 are preferably sufficiently fine to retain a majority of the suspended particles larger than about 3 mm (0.125 in.). The dimensions of the second perforate strainer are preferably selected to provide in the second perforate strainer at least the quantity of open area available in the first perforate strainer 50.

The first and second perforate strainers are preferably constructed of a material resistant to corrosion under circulating water system reservoir conditions. Material selection will depend upon, among other factors, makeup water quality and the type and quantity of chemical additives injected into the circulating water system. Additionally, the impeller housing material must be considered to avoid galvanic corrosion between the strainers and the impeller housing. Suitable strainer materials for cooling water service include both the ferritic (e.g. Type 410) and austenitic (e.g. Types 304 and 316) stainless steels.

The primary and secondary strainers preferably comprise either perforate plate or woven wire. Woven wire advantageously provides relatively greater open area per square area. However, its flexibility may require an underlying structural frame to prevent collapse of the secondary strainer cage due to pump suction. Perforate plate typically requires no additional structural frame.

SYSTEM OPERATION

Before startup of a circulating water system employing the method and apparatus of the present invention, the reservoir (sump) should be cleared of particulates. To fully attain the benefits of the invention, the circulating water system should be taken out of service and all heat exchangers and vessels should be cleaned and flushed. Erosion and corrosion damage should be repaired with suitable erosion-resistant material to minimize particulate production during operation of the circulating water system. Piping should be inspected, cleaned and flushed.

The circulating water system reservoir is then filled with water and the initial dosage of treatment chemicals as described above and detailed in the cited references. The operating characteristics (e.g. harmonic vibration frequencies, outlet pressure and flowrate, driver speed in rpm and equilibrium operating temperature) of the sump pump with clean primary and secondary strainers are then recorded. In the most preferred embodiment of the invention, at least one of the listed pump operating characteristics is monitored by electronic instrumentation which indicates an alarm condition upon sensing, for example, a marked increase in amplitude or change in frequency of the harmonic pump vibrations, a decrease in outlet pressure, flowrate or driver rpm, or an increase in the operating temperature above the recorded equilibrium point. Alternatively, however, an operating technician may record and evaluate one or more of the pump operating characteristics several times per eight-hour shift to monitor pump operation.

As the operating run progresses, particulates accumulate in the reservoir and on the outside surface of the secondary strainer. Rather than plugging in-line filters, the particulates settle out in the reservoir, an area of relatively low liquid velocity. Thus heat exchanger tubes remain open to liquid flow for a longer period of time during the operating run, improving not only instantaneous heat transfer, but also the total integral heat transfer available during the operating run. Particulate accumulation on the secondary strainer is accompanied by a cavitation of the pump, which may be indicated by a change in pump harmonic vibration frequencies, a decrease in outlet pressure and flowrate, and an increase in equilibrium operating temperature.

Substantial deflection of the pump operating characteristics from those measured during clean strainer operation to indicates excessive mechanical loading or uneconomic system operation due to low flow. Such conditions indicate that a maintenance shutdown to clear the process equipment of accumulated particulates is imminent. The present invention, however, enables the circulating water system operating technician to prepare for an orderly maintenance shutdown rather than to force a shutdown due to operating problems. This is indeed a highly advantageous feature of the invention which reduces the likelyhood of damage to costly process equipment due to unexpected interruptions in water flow.

To maintain water flow while preparing for the system shutdown, the perforate door 60 is opened by engaging and urging upwardly lift ring 70. This step is most preferably accomplished by an automatic mechanical actuator (not shown) controlled by the pump monitoring instrumentation as described above. Such mechanical actuators, or servos, are well known by those skilled in the art. Alternatively, however, the lift ring may be engaged manually via an elongated rod.

Raising the lift ring opens the perforate door 60 and exposes the first perforate strainer to unfiltered water. Flow through the sump pump then increases in response to the lowered pressure drop across the first strainer. With this extra margin of time, the circulating water system may be readied for an orderly maintenance shutdown. During operation with the first perforate strainer only, a small volume of particulates having major diameters smaller than the perforations of the first strainer may enter the downstream process equipment. However, this volume is believed to be miniscule in comparison with the bulk of the particulates excluded from the process equipment during normal operation in accordance with the present invention.

Changes and modifications in the specifically described embodiments can be carried out without departing from the scope of the invention which is intended to be limited only by the scope of the appended claims.

What is claimed is:

1. A centrifugal sump pump for withdrawing liquid from a reservoir comprising:

(a) a pump housing having motor mount means at an upper end;

(b) a pump intake conduit affixed to a lower end of said pump housing, said intake conduit having a fluid intake opening;

(c) a first perforate strainer covering said fluid intake opening;

(d) a second perforate strainer encasing said first perforate strainer, said second perforate strainer having finer perforations than said first perforate strainer and having open area at least equal to that of said first perforate strainer;

(e) a perforate door in said second perforate strainer hingeable attached to said second perforate strainer, said perforate door including means for retaining said perforate door closed during normal pump operation;

(f) lifting means attached to said perforate door for remotely opening said perforate door.

2. The centrifugal sump pump of claim 1 further comprising a sustantially vertical cylidrical pump housing.

3. The centrifugal sump pump of claim 2 wherein said second perforate screen is substantially cylindrical.

4. The centrifugal sump pump of claim 3 wherein said perforate door faces downwardly.

5. The centrifugal sump pump of claim 1 wherein said first and said second perforate strainers are constructed of a material resistant to corrosion under cooling tower sump conditions.

6. The centrifugal sump pump of claim 5 wherein said first and said second perforate strainers are constructed of stainless steel.

7. The centrifugal sump pump of claim 1 wherein said lifting means comprise a lift ring.

8. A method for improving the heat transfer efficiency and decreasing maintenance downtime by reducing particulate accumulation in a circulating cooling water system employing a centrifugal sump pump comprising the step of:

(a) positioning a first perforate strainer and a second perforate strainer to cover the fluid intake opening of said centrifugal sump pump, said second perforate strainer encasing said first perforate strainer and including a perforate door having means in association with said perforate door for retaining said perforate door closed during normal pump operations, said second perforate strainer having finer perforations than said first perforate strainer and having open area at least equal to that of said first strainer;

(b) removing particulates from cooling water entering said fluid intake opening of said centrifugal sump pump by retaining said particulates on said second perforate strainer;

(c) monitoring the operation of said centrifugal sump pump to detect insufficient fluid flow through said centrifugal sump pump; and (d) opening said perforate door to increase fluid flow through said centrifugal sump pump for a time sufficient to prepare said circulating cooling water system for orderly shutdown.

9. The method of claim 8 wherein said pump monitoring step further comprises measuring the amplitude of pump vibration.

10. The method of claim 8 wherein said pump monitoring step further comprises analyzing the frequency spectrum of pump vibration.

11. The method of claim 8 wherein said pump monitoring step further comprises measuring pump outlet pressure.

12. The method of claim 8 wherein said pump monitoring step further comprises measuring pressure drop across said second perforate strainer.

* * * * *

UNITED STATES PATENT AND TRADEMARK OFFICE

CERTIFICATE OF CORRECTION

PATENT NO. : 4,898,513

DATED : February 6, 1990

INVENTOR(S) : C.C. Hon

It is certified that error appears in the above-identified patent and that said Letters Patent is hereby corrected as shown below:

| | |
|---|---|
| Col. 4, line 59 | "positin" should be --position-- |
| Col. 7, claim 1, line 16 | "hingeable" should be --hingably-- |

Signed and Sealed this

Twelfth Day of February, 1991

*Attest:*

*Attesting Officer*

HARRY F. MANBECK, JR.

*Commissioner of Patents and Trademarks*